US006439913B1

(12) United States Patent
Ma

(10) Patent No.: US 6,439,913 B1
(45) Date of Patent: Aug. 27, 2002

(54) SIMPLIFIED ZIF SOCKET ASSEMBLY

(75) Inventor: Hao-Yun Ma, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/893,857

(22) Filed: Jun. 27, 2001

(30) Foreign Application Priority Data

Jun. 15, 2001 (TW) ..... 90210063 U

(51) Int. Cl.[7] ..... H01R 4/50
(52) U.S. Cl. ..... 439/342; 439/259
(58) Field of Search ..... 439/342, 259–265, 439/266–268, 70

(56) References Cited

U.S. PATENT DOCUMENTS 5,658,160 A * 8/1997 Lai ..... 439/342
6,171,128 B1 * 1/2001 Huang et al. ..... 439/342
6,210,197 B1 * 4/2001 Yu ..... 439/342

* cited by examiner

*Primary Examiner*—Hien Vu
(74) *Attorney, Agent, or Firm*—Wei Te Chung

(57) ABSTRACT

A ZIF socket assembly used with a chip (6) comprises a ZIF socket (5), an external actuating tool (8) and a protector (7). The socket comprises a base (51) and a sliding cover (53). The base comprises a recess (514) on an end thereof. The sliding cover is movably assembled on the base for receiving the chip and comprises a slot (514) in alignment with the recess. The protector is placed upon the chip and comprises a number of legs (71) extending downwardly for pressing against edges of the chip. A contacting portion (73) extends upwardly from an end of the protector for dispersing a force exerting on the chip. The actuating tool is inserted into the recess through the slot and drives the cover, the chip and the protector to move with respect to the base, thereby achieving an electrical connection between the chip and the socket.

1 Claim, 5 Drawing Sheets

SIMPLIFIED ZIF SOCKET ASSEMBLY

BACKGROUND OF THE INVENTION

1. Field of the Invention

The present invention relates to a ZIF socket assembly, and particularly to a ZIF socket assembly which can move a sliding cover on a base with an actuating tool.

2. Description of Related Art

ZIF socket is widely used for connecting an integrated circuit chip with a printed circuit board. A conventional ZIF socket includes a base, a sliding cover movably assembled on the base and a cam lever rotatably sandwiched between the base and the sliding cover. The cam lever is rotated by manipulation and carries the sliding cover to move on the base thereby achieving a ZIF purpose. Recently, for consideration of the miniaturization of all kinds of device, particularly of the portable computer, the ZIF socket has to reduce its size or height. The conventional ZIF socket operated by cam lever, which is for example disclosed by U.S. Pat. No. 5,057,031, cannot meet the trend of miniaturization. U.S. Pat. No. 5,730,615 discloses a lowprofile ZIF socket of which a sliding cover is operated by an actuating tool and moves on a base. However, for achieving enough movement of an integrated circuit chip, the actuating tool will press against the integrated circuit chip directly and may damage the integrated circuit chip. Therefore, in actual application, a protector is provided upon the integrated circuit chip for preventing the integrated circuit chip from being subjected to force directly.

Referring to FIGS. 4 and 5, a ZIF socket assembly for connecting an integrated circuit chip 2 with a mating printed circuit board (not shown) comprises a ZIF socket 1 and a protector 3. The ZIF socket 1 comprises a base 10 and a sliding cover 11 movably assembled on the base 10. The base 10 comprises a recess 101 at an end thereof. The sliding cover 11 defines a slot 111 in vertical alignment with the recess 101 of the base 10. The integrated circuit chip 2 is mounted on the sliding cover 11. The protector 3 is placed upon the integrated circuit chip 2 and comprises a plurality of legs 31 extending downwardly from each edge thereof and pressing against the integrated circuit chip 2. Referring to FIG. 5, in manipulation, an actuating tool 4 is inserted into the recess 101 through the slot 111 and rotated to drive the sliding cover 11 and the integrated circuit chip 2 to move with respect to the base 10 thereby achieving an electrical connection between pins 20 of the chip 3 and terminals 100 of the socket 1.

However, when the actuating tool 4 is rotated to a position shown in FIG. 5, the actuating tool 4 will apply a large force on the protector 3 of which a downward component will press the chip 2 through the protector 3 and may break the chip 2.

Hence, an improved protector arrangement is required to overcome the disadvantages of the conventional ZIF socket assembly.

SUMMARY OF THE INVENTION

Accordingly, the object of the present invention is to provide a ZIF socket assembly with an improved protector which can disperse a force pressing on a chip when a actuating tool drives the chip to move with respect to a base of the socket.

In order to achieve the object set forth, a ZIF socket assembly for use with an integrated circuit chip comprises a socket, an actuating tool and a protector. The socket comprises a base, a plurality of terminals and a sliding cover. The base comprises a plurality of receiving passageways for receiving corresponding terminals and a lower flange extending outwardly from an end thereof. The lower flange defines a recess on an upper face thereof. The sliding cover is movably assembled on the base for receiving the chip and comprises a plurality of through holes in vertical alignment with corresponding receiving passageways. An upper flange extends outwardly from an end of the cover and defines a slot in vertical alignment with the recess of the base. The protector is placed upon the chip and comprises a plurality of the legs extending downwardly for contacting with edges of the chip. A contacting portion extends upwardly from an end thereof for dispersing a force exerting on the chip by the protector. The actuating tool is inserted into the recess through the slot and rotated to press against the protector. Therefore, a force is applied on the protector by the actuating tool. A downward component of the force enhances the protector and the chip together and is scattered by the upward contacting portion. A horizontal component of the force drives the cover, the chip and the protector to move with respect to the base thereby achieving an electrical connection between the socket and the chip.

Other objects, advantages and novel features of the invention will become more apparent from the following detailed description when taken in conjunction with the accompanying drawings.

DETAILED DESCRIPTION OF THE INVENTION

Figure 1:
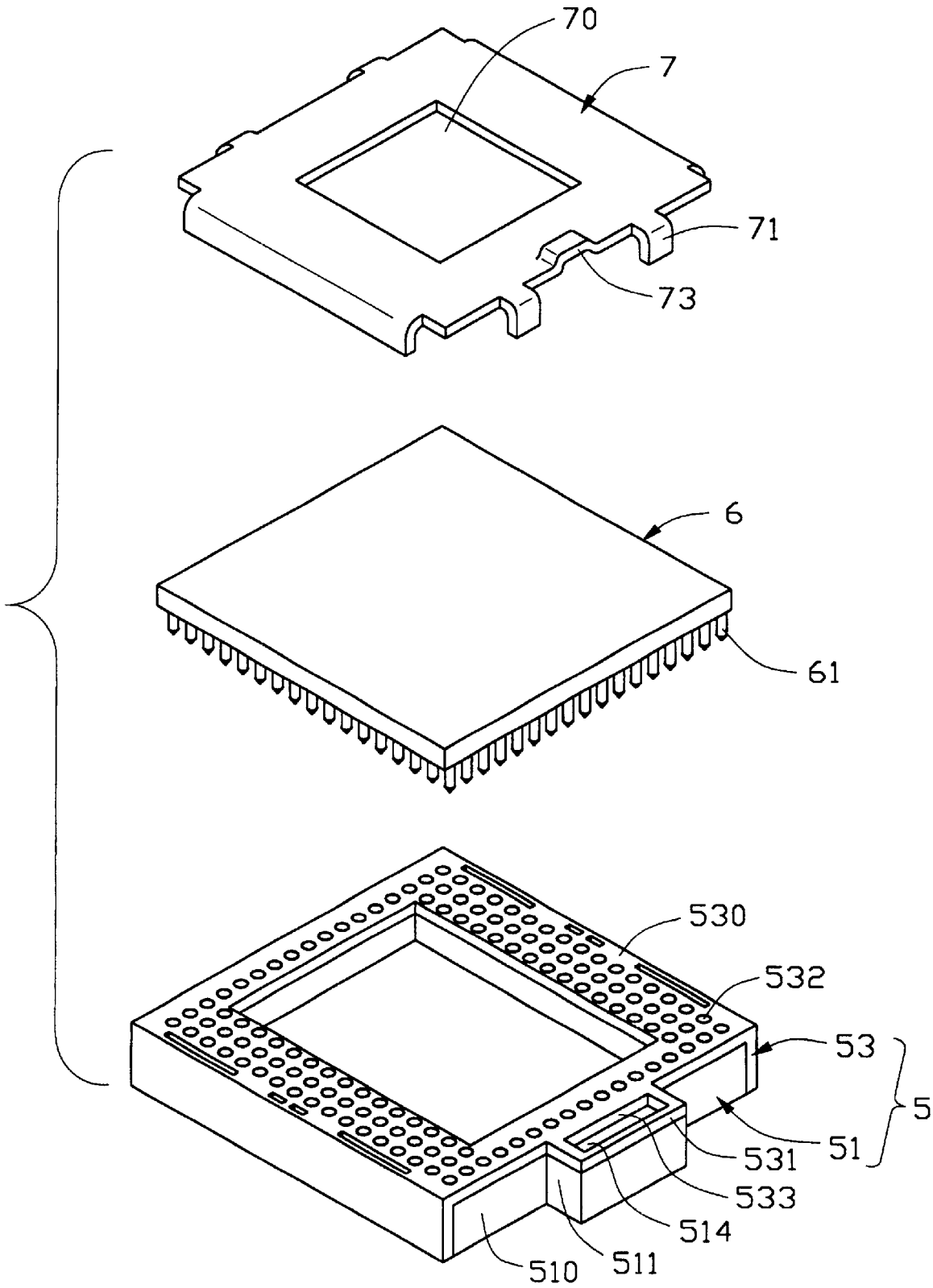
FIG. 1 is a perspective exploded view of a ZIF socket assembly with a protector of the present invention.

Reference will now be made to the drawing figures to describe the present invention in detail.

Figure 3:
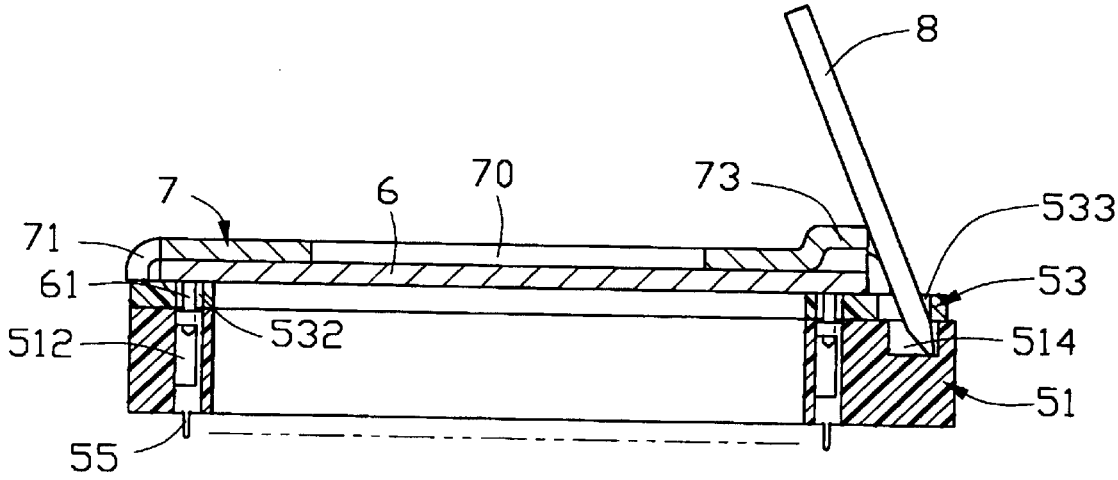
FIG. 3 is a cross-sectional view of the ZIF socket assembly when an actuating tool is driving the protector, a chip and a sliding cover of the socket to move with respect to a base of the socket.
Figure 4:
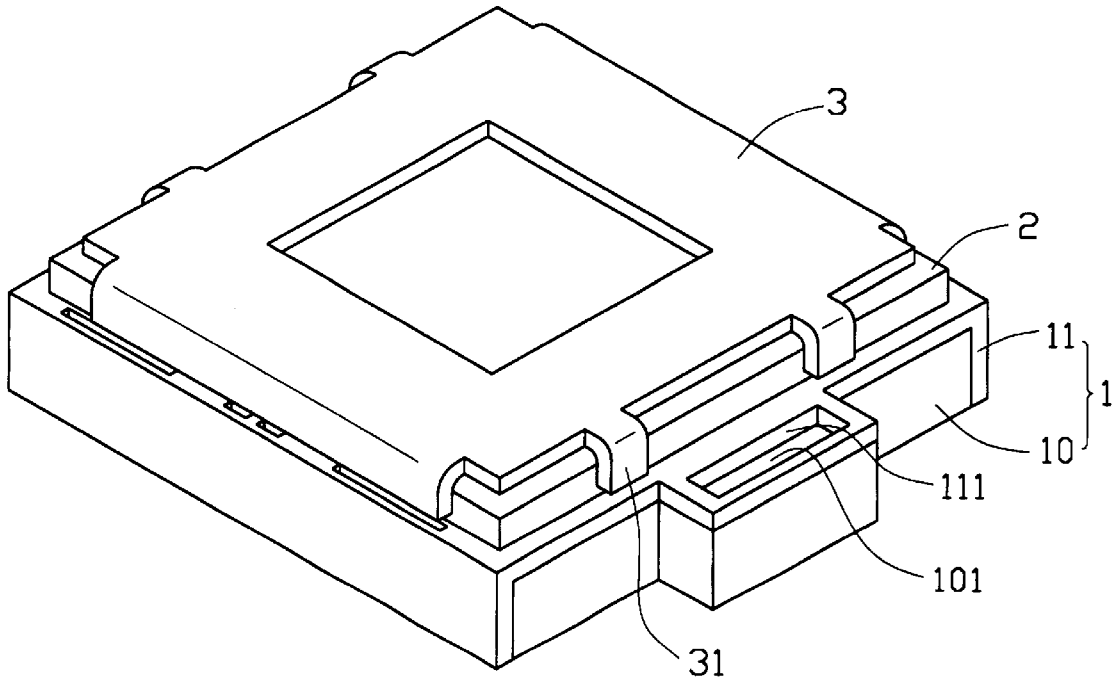
FIG. 4 (PRIOR ART)
FIG. 4 is a perspective assembled view of a conventional ZIF socket assembly with a protector.
Figure 5:
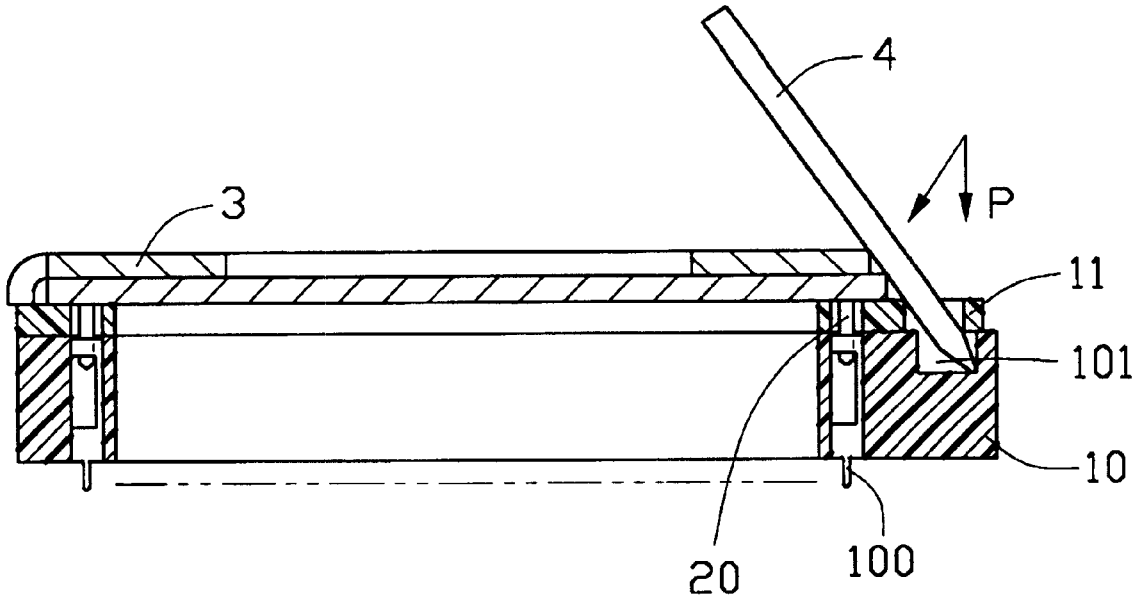
FIG. 5 (PRIOR ART)
FIG. 5 is a cross-sectional view similar to FIG. 3 but showing operation of the conventional socket of FIG. 4.

Referring to FIGS. 1 and 3, a ZIF socket assembly comprises a ZIF socket 5 and a protector 7. The ZIF socket 5 comprises a base 51, a sliding cover 53 movably assembled on the base 51 and a plurality of terminals 55 received in the base 51.

The base 51 comprises a lower rectangular member 510 and a lower flange 511 extending outwardly from an end of the lower rectangular member 510. The lower rectangular member 510 defines a plurality of spaced apart receiving passageways 512 extending vertically through the base 51 for receiving corresponding terminals 55. The lower flange 511 defines a recess 514 on an upper face thereof.

The sliding cover 53 comprises an upper rectangular member 530 and an upper flange 531 extending outwardly from an end of the upper rectangular member 530. The upper rectangular member 530 defines a plurality of through holes 531 in alignment with corresponding receiving passageways 512 of the base 51 for receiving corresponding pins 61 of a mating integrated circuit chip 6. The upper flange 531 defines a rectangular slot 533 in vertical alignment with the recess 514 of the base 51.

The protector 7 is assembled on the chip 6 and comprises a square opening 70 in the middle thereof and a plurality of legs 71 extending downwardly from each edge thereof. A vaulted contacting portion 73 extends upwardly from a lateral end of the protector 7.

Figure 2:
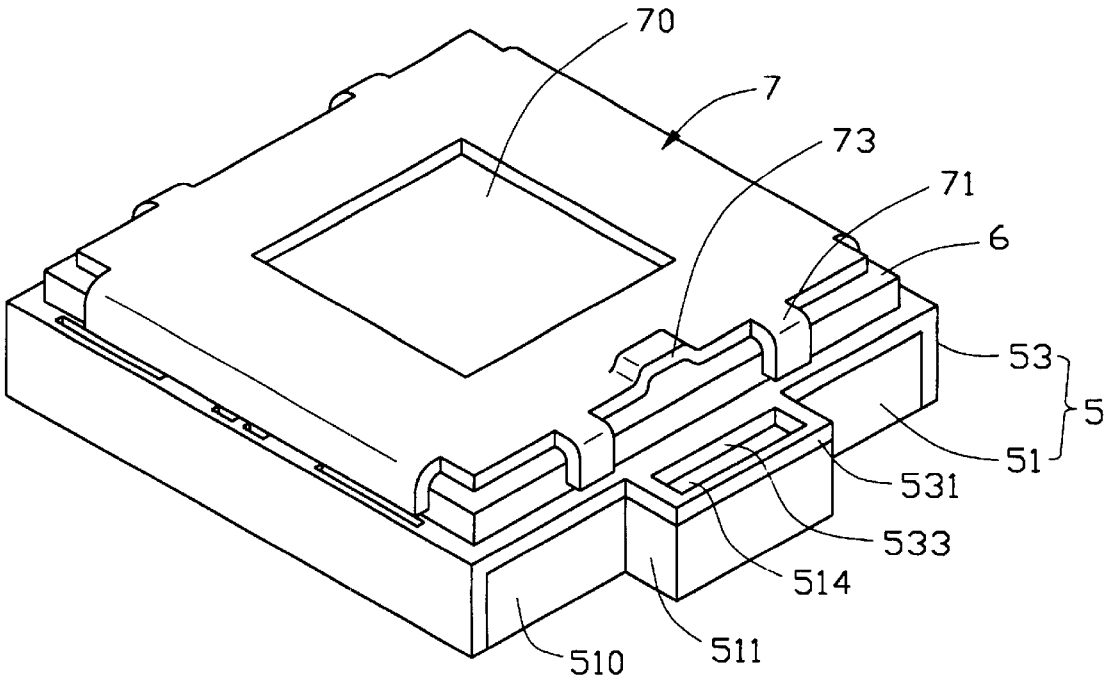
FIG. 2 is a perspective view of the assembled ZIF socket assembly.

In assembly, referring to FIGS. 2 and 3, the terminals 55 are placed in the receiving passageways 512 of the base 51 and the sliding cover 53 is movably assembled on the base 51 with the through holes 532 in vertical alignment with corresponding receiving passageways 512. The chip 6 is then placed on the sliding cover 53 with the pins 61 received in corresponding receiving passageways 512 through corresponding through holes 532. The protector 7 is finally placed on the chip 6 with the leg 71pressing against edges of the chip 6 and the vaulted contacting portion 73 towards the flanges 511, 531. In manipulation, an actuating tool 8 is inserted into the recess 514 of the base 51 through the slot 533 of the sliding cover 53. Successively, the actuating tool 8 is rotated and applies a force on the protector 7. A downward component of the above force enhances the protector 7 and the integrated circuit chip 6 together and a horizontal component of the above force drives the sliding cover 53, the protector 7 and the integrated circuit chip 6 to move with respect to the base 51. Therefore, an electrical connection between the pins 61 of the chip 6 and the terminals 55 of the socket 5 is achieved.

Since the vaulted contacting portion 73 extends upwardly from the end of the protector 7, the downward component that the actuating tool 8 pressing against the protector 7 will be scattered by the vaulted contacting portion 73. The pressure that the protector 7 brings on the chip 6 will be reduced, therefore, the chip 6 is protected better by the protector 7 than the prior art.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A ZIF socket assembly comprising:

a socket including a base and a cover slidably mounted upon said base in a front-to-back direction;

a plurality of terminals disposed in the base;

a plurality of through holes in the cover in alignment with the corresponding terminals, respectively;

a recess formed around one end of the base;

a slot defined around one end of the cover in alignment with the recess;

an integrated circuit chip positioned upon the cover; and a protector disposed on the integrated circuit chip; wherein said protector includes a plurality of legs extending downwardly for attaching to and protecting edges of the integrated circuit chip and a raised contacting portion extending upwardly from one end thereof and being located above the integrated circuit chip and adjacent to both said recess and said slot and in between said legs whereby a tool is adapted to be inserted into both the recess and the slot and to be rotatably moved relative to the base and engage the raised contacting portion to move all the cover, the integrated circuit chip and the protector in said front-to-back direction while without touching or imposing downward forces upon the integrated circuit chip.

* * * * *